US005550725A

United States Patent [19]

Shemitz et al.

[11] Patent Number: 5,550,725

[45] Date of Patent: Aug. 27, 1996

[54] ADJUSTABLE LUMINAIRE AND MOUNTING SYSTEM THEREFOR

[75] Inventors: Sylvan R. Shemitz; David B. Miller; Gregory L. Moler, all of Woodbridge, Conn.

[73] Assignee: Sylvan R. Shemitz Designs, Inc., West Haven, Conn.

[21] Appl. No.: 333,856

[22] Filed: Nov. 3, 1994

[51] Int. Cl.[6] ..... F21V 21/29

[52] U.S. Cl. ..... 362/282; 362/147; 362/287; 362/430

[58] Field of Search ..... 362/282, 220, 362/147, 287, 260, 418, 429, 430, 432, 219, 225

[56] References Cited

U.S. PATENT DOCUMENTS

| | | | |
|---|---|---|---|
| Re. 12,795 | 5/1908 | Beuttell . | |
| 2,032,791 | 3/1936 | Cartun | 176/29 |
| 2,905,809 | 9/1959 | Pascucci | 240/51.11 |
| 2,922,029 | 1/1960 | Eschelbach et al. | 240/2 |
| 3,108,751 | 10/1963 | Rodmaker et al. | 240/51.11 |
| 3,138,418 | 6/1964 | Dazley et al. | 339/50 |
| 3,265,886 | 8/1966 | Wigert | 240/51.11 |
| 3,955,078 | 5/1976 | Eggers et al. | 240/52 R |
| 4,161,019 | 7/1979 | Mulvey | 362/147 |
| 4,177,504 | 12/1979 | Henderson, Jr. et al. | 362/282 |
| 4,245,284 | 1/1981 | Moore et al. | 362/311 |
| 4,320,885 | 3/1982 | Kawazoe | 248/222.1 |
| 4,368,506 | 1/1983 | Rapp | 362/147 |
| 4,480,809 | 11/1984 | Healey | 248/185 |
| 4,535,393 | 8/1985 | Aspenwall | 362/217 |
| 4,796,169 | 1/1989 | Shemitz | 362/432 |
| 4,881,156 | 11/1989 | Shemitz et al. | 362/220 |
| 4,961,127 | 10/1990 | Shemitz et al. | 362/429 |

FOREIGN PATENT DOCUMENTS

| | | |
|---|---|---|
| 0410582 | 1/1991 | European Pat. Off. . |
| 2113817 | 8/1983 | United Kingdom . |

*Primary Examiner*—Denise L. Gromada
*Assistant Examiner*—Alfred Basichas
*Attorney, Agent, or Firm*—Fish & Neave; Jeffrey H. Ingerman

[57] ABSTRACT

An adjustable elongated luminaire or elongated luminaire system, and a respective adjustable mount or mounting system therefor, that further minimizes dark spots in the lighting pattern, while allowing easy installation and adjustment, and providing a more effective braking mechanism, as compared to previously known systems, are provided. In a preferred embodiment, each luminaire has a hole at one end and a projecting stud at the other end. A mounting bracket for each end has a corresponding hole or stud. Where two adjacent luminaires meet in a luminaire system, the mounting bracket has a hole, and the stud of one luminaire extends through the hole in that mounting bracket as well as the hole in the adjacent luminaire. Brake mechanisms to lock one or more luminaires rotationally, and alignment mechanisms to lock multiple luminaires in a system into common alignment, can also be used.

62 Claims, 6 Drawing Sheets

FIG. 1
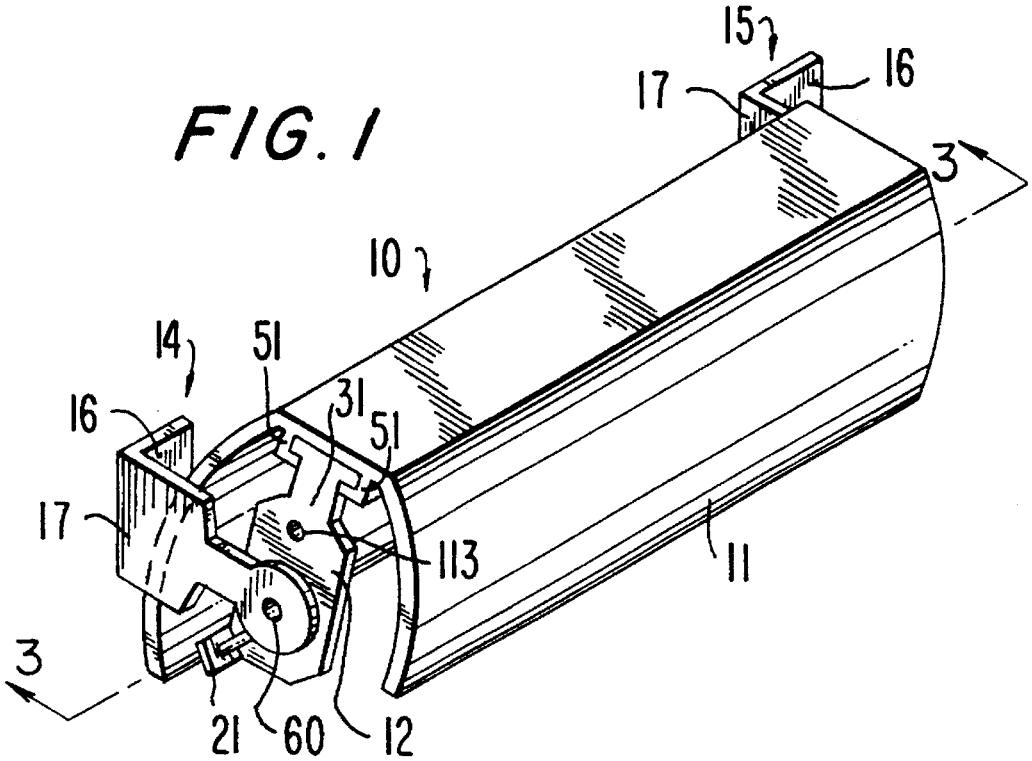
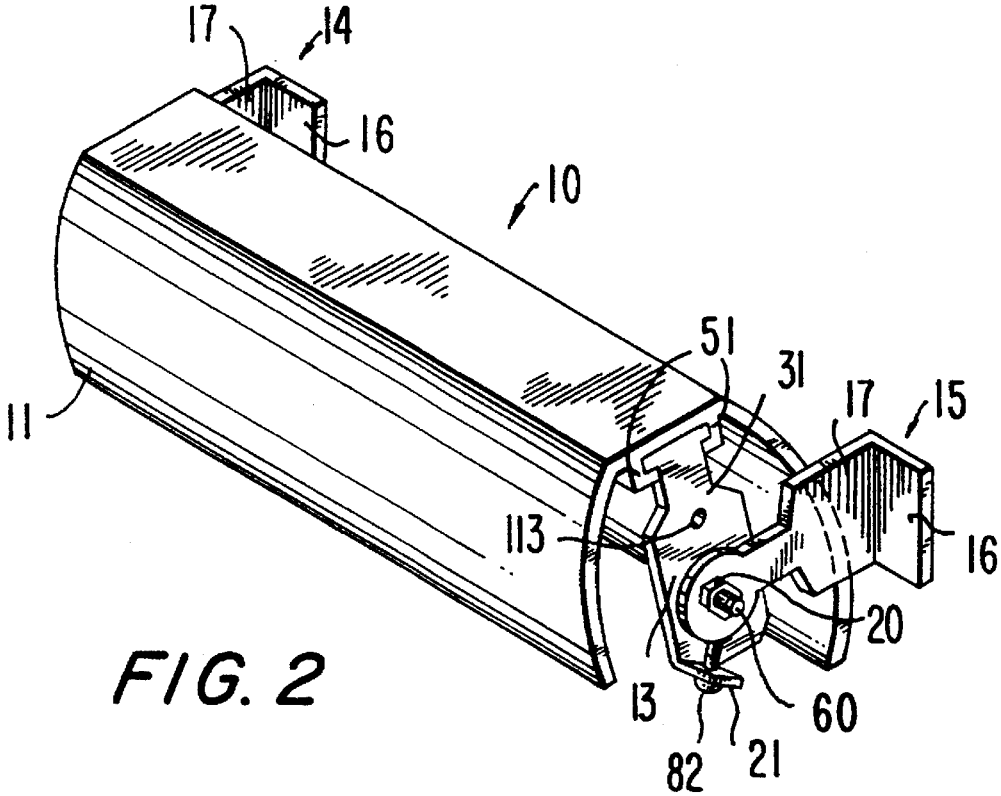
FIG. 2

ADJUSTABLE LUMINAIRE AND MOUNTING SYSTEM THEREFOR

BACKGROUND OF THE INVENTION

This invention relates to a mount for adjustably mounting an elongated luminaire, or an elongated system of such luminaires, to a wall, a ceiling or other mounting surface.

It is common to mount elongated luminaires, such as those having elongated reflectors housing elongated light sources including fluorescent tubes, on surfaces such as walls and ceilings, using brackets rotatably fastened to the ends of the reflectors. The rotational fastening allows for adjustability of the luminaire about its longitudinal axis, so that the light produced can be aimed properly at the desired surface or subject.

Once the luminaire is properly aimed, it is desirable to lock it in place rotationally, to prevent the aim from slipping. In previously known luminaires, such rotational locking of a luminaire about the long axis of its elongated reflector generally was accomplished by tightening a fulcrum screw and nut used to attach the reflector to the mounting brackets. However, normal luminaire use, as well as ambient vibrations, would sometimes cause the screw and nut to become loose and the reflector to rotate out of its desired position.

Additionally, certain lighting applications require luminaires with elongated reflectors to be mounted adjacently, end-to-end, in elongated systems of elongated luminaires. If such mounting is achieved using screws, nuts and brackets as described above, the resulting configuration generally produces dark spots in the lighting pattern on an adjacent ceiling or wall near the location at which one lamp ends and the next lamp begins. Such dark spots are caused by the large end-of-lamp intervals necessarily found in mounting configurations such as that described above. For example, in some previously known luminaires, the end-of-lamp intervals (space between lighted portions of lamps) are approximately three and one-half inches.

An alternative mounting configuration is described in commonly-assigned U.S. Pat. No. 4,881,156, which is hereby incorporated by reference in its entirety. In the configuration described in that patent, adjacent reflectors are attached to two separate, but closely spaced, parallel arms of a single mounting bracket, allowing the ends to be closer together. To minimize the distance between the arms while still providing for rotational locking of the reflectors, separate locking clamps are provided to clamp each reflector to is respective arm. The locking clamps are accessible from inside each reflector, eliminating the need to space the arms farther apart to allow access.

The luminaire configuration described in said above-incorporated U.S. Pat. No. 4,881,156 is not without its own disadvantages. Although the lamps are closer together, there are still some perceptible dark spots in the lighting pattern. Moreover, the large number of parts, such as in the locking clamps, complicates installation of the luminaires. In addition, harsh vibrations can still adversely affect the rotational locking.

It would therefore be desirable to be able to provide an adjustable luminaire or luminaire system, and a respective adjustable mount or mounting system therefor, that would further minimize dark spots in the lighting pattern, while allowing easy installation and adjustment, and providing a more effective braking mechanism, as compared to previously known systems.

SUMMARY OF THE INVENTION

It is an object of this invention to provide an adjustable luminaire or luminaire system, and a respective adjustable mount or mounting system therefor, that would further minimize dark spots in the lighting pattern, while allowing easy installation and adjustment, and providing a more effective braking mechanism, as compared to previously known systems.

In accordance with this invention, there is provided an adjustable luminaire for attachment to a mounting surface. The adjustable luminaire includes an elongated reflector. The reflector has first and second ends and extends lengthwise in a first direction between the first and second ends. The luminaire also includes two end brackets, each of the end brackets having an end bracket flange for mating with the reflector, and an end plate substantially perpendicular to the flange. The luminaire further has two mounting brackets for attaching it to the mounting surface, each of the mounting brackets having a mounting flange for attaching to the mounting surface, and a mounting plate substantially perpendicular to the mounting flange for attaching to the end plate. At each end, one of the end plate and the mounting plate bears a mounting stud and the other of the end plate and the mounting plate has a hole therein for rotatably receiving the mounting stud, whereby the reflector is rotatably adjustable within a range of adjustment about an axis extending from the first end to the second end along the first direction.

Each mounting plate has a mounting plate edge, and at least one of the end plates has a brake for cooperating with the mounting plate edge of a respective one of the mounting plates to lock the reflector against rotation about the axis.

An adjustable mount for such a luminaire is also provided. In addition, a luminaire system, including several such luminaires end-to-end, as well as an adjustable mounting system for such a luminaire system, are also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 1 is a longitudinal perspective view of a preferred embodiment of an adjustable luminaire and an adjustable mount according to the present invention, seen from a first end;

FIG. 2 is a longitudinal perspective view of the embodiment of FIG. 1, seen from a second end;

DETAILED DESCRIPTION OF THE INVENTION

Figure 3:
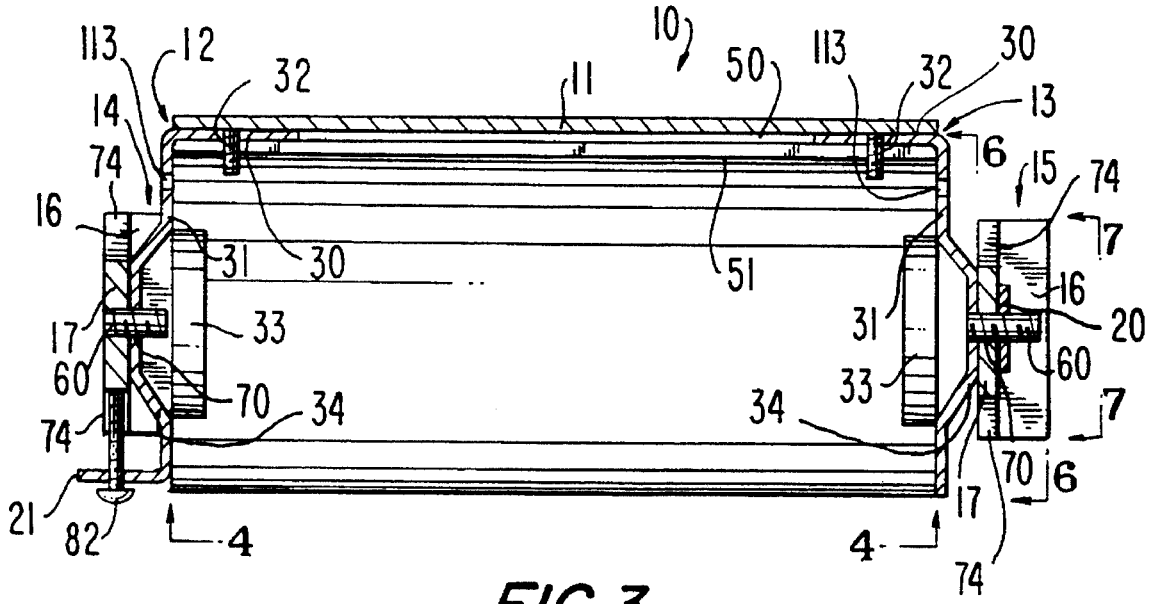
FIG. 3 is a longitudinal cross-sectional view, partly in elevation, of the embodiment of FIGS. 1 and 2, taken from line 3—3 of FIG. 1.
Figure 4:
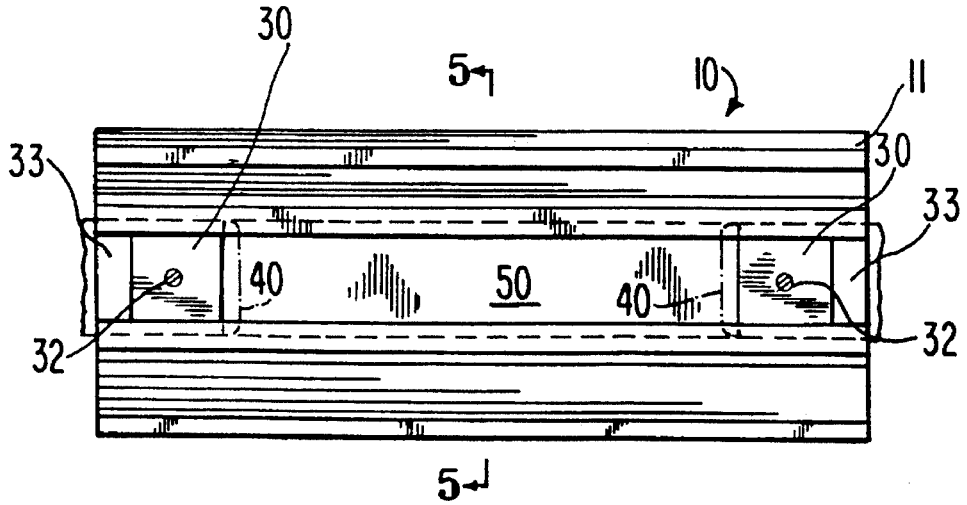
FIG. 4 is an elevational view of a reflector used in the present invention.
Figure 5:
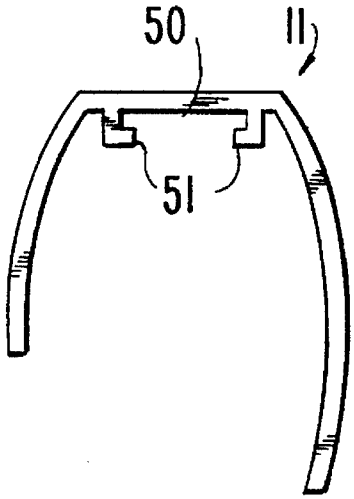
FIG. 5 is a cross sectional view of the reflector of FIG. 4, taken from line 5—5 of FIG. 4.
Figure 6:
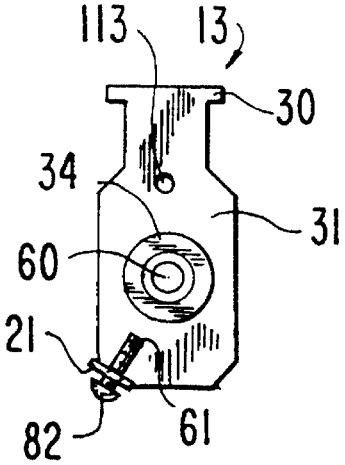
FIG. 6 is a side elevational view of an end bracket according to the invention, taken from line 6—6 of FIG. 3.
Figure 7:
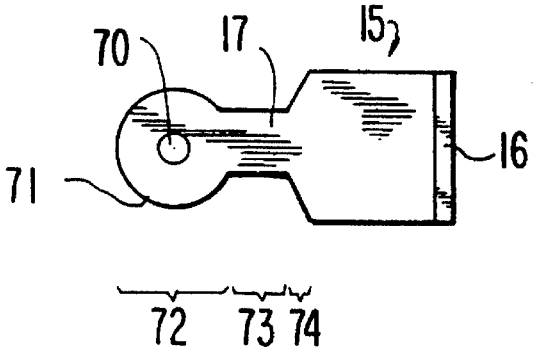
FIG. 7 is a side elevational view of a mounting bracket according to the present invention, taken from line 7—7 of FIG. 3.
Figure 8:
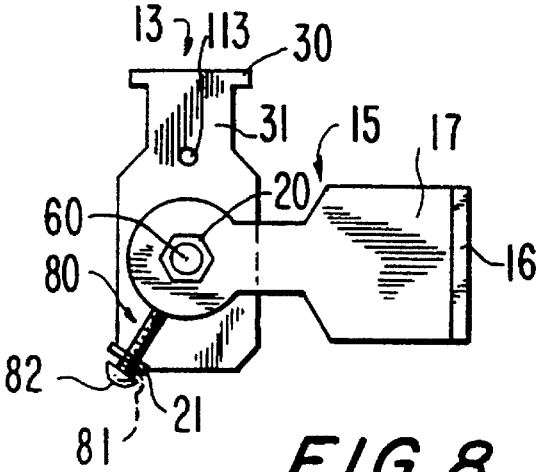
FIG. 8 is an elevational view of the mounting bracket of FIG. 7 cooperating with the end bracket of FIG. 6.

An adjustable luminaire according to the present invention includes a reflector, two end brackets, and two mounting brackets. The reflector houses one or more lamps, attached to a lampholder or lampholders that preferably are mounted on one or both end brackets. The end brackets and mounting brackets together make up an adjustable mount for the luminaire. At each end, either the end bracket or the mounting bracket bears a stud, while the other has a hole through which the stud extends. The luminaire can rotate about the axis defined by the studs, but cannot translate. As explained in more detail below, a fastener may or may not be used on one or both studs.

The adjustable mount can be locked by a brake element on the end bracket that acts on the edge of the mounting bracket. The end bracket is shaped so that at its edge, it is spaced from the plane in which it abuts the mounting bracket at its center, with a projection that extends over the edge of the mounting bracket carrying the brake element. Preferably, the brake element is a screw extending through a threaded hole in the projection, with its tip bearing against the edge of the mounting bracket, which is shaped to allow a desired range of rotation while remaining in range of the braking screw. The brake thus acts in the common plane of the two brackets, minimizing the space occupied by the adjustable mount. Although the end brackets at both ends are preferably identical, and thus both capable of bearing braking screws, in the preferred embodiment the brake is applied only at one end.

In an adjustable luminaire system according to the invention, two or more luminaires are placed end-to-end. The two adjacent end brackets of adjacent luminaires are both attached to the same mounting bracket, forming an adjustable mounting system with significant space savings over previously known adjustable mounting systems. Because the two end brackets, though preferably identical, are facing in opposite directions, their respective projections, bearing the braking screws, do not interfere with one another, at least when the two reflectors are aimed in the same direction. The reflectors can be aimed in different directions, but that ability is limited because the two projections will not be able to rotate past one another. Alternatively, if the two end brackets were not identical, as discussed in more detail below, they would be able to rotate past one another. In any event, in the preferred embodiment, all of the luminaires are aimed in the same direction, and aligners are used to maintain their aim in the same direction. Preferably, the aligners are screws passing through alignment holes in adjacent end brackets.

In such an adjustable mounting system, the mounting brackets and end brackets again would bear studs and holes to receive the studs. In one embodiment, each luminaire has an end bracket at each end which has a hole. All of the studs would be on the mounting brackets, with all of the end brackets having holes. In that embodiment, the mounting bracket at each end of the system would have one stud, facing inward toward the opposite end, while each intermediate mounting bracket would have two studs, one facing in each direction.

In a second, more particularly preferred embodiment, each luminaire has an end bracket at one end which has a hole, and an end bracket at the other end which has a stud. All of the mounting brackets have holes for receiving the studs, except the mounting bracket at one end of the system which has a stud. At that one end of the system, the stud on the mounting bracket is inserted in the hole in the end bracket of the luminaire at that end. At the other end of the system, the stud on the end bracket on the corresponding end of the last luminaire is inserted in the hole in the last mounting bracket. At the intermediate mounting brackets, the stud from the end bracket at the second end of each luminaire passes through the hole in the mounting bracket and then through the hole in the first end bracket of the next luminaire. This type of mount could also be used for a single luminaire.

If the last type of mount is used, so that the two end brackets of each luminaire have to be different (by virtue of having either a stud or a hole), then it is possible to make them so different that they can rotate past each other if desired. For example, because it is preferred that the braking screw be used only at one end of each luminaire, the projection bearing the screw hole can be omitted at one end. Alternatively, the braking screw hole projection at one end can be provided at a different radius from the rotational axis than the braking screw hole projection at the other end, so that the projections can rotate past one another, at least when the screws are not in them.

In all of the embodiments described above, the attachment of the mounting brackets to the underlying mounting surface can be relied on to prevent the studs from being withdrawn from their corresponding holes. If the mounting brackets are attached to the mounting surface, they cannot be moved longitudinally, and thus the studs cannot be withdrawn from the holes. Alternatively and preferably, for added safety and security, at least the stud at the end of the system can be threaded, and a fastener, such as a threaded nut, can be applied to the protruding end of the stud. If desired, nuts could be used on the intermediate studs as well.

In the preferred embodiment, the end brackets serve as the end walls of each luminaire, with the lampholder or lampholders mounted on the inner sides of the end brackets. Each end bracket preferably has an end plate on which the lampholder and the stud or hole are located, as well as a flange substantially perpendicular to the end plate for attachment to the reflector. A particularly preferred reflector is the ELLIPTIPAR® reflector available from Elliptipar, Inc, of West Haven, Conn., which has a wireway channel integrally formed therein along its entire length. The end bracket flange is preferably sized to fit into that channel, and preferably bears a set screw for tightening against the wall of the channel to prevent removal of the flange from the channel. Other similarly constructed reflectors could be used. Alternatively, a reflector could be used that is provided with an individual recess at each end, extending only a short distance from the end, for the purpose of accepting the end bracket flange. Other methods of attachment of the end bracket to the reflector, such as rivets or screws, could also be used.

A first preferred embodiment of a single luminaire, and an adjustable mount therefor, according to the invention, are shown in FIGS. 1–8. Luminaire 10 includes elongated reflector 11, end brackets 12, 13 and mounting brackets 14, 15. Reflector 11 preferably includes a flat wireway channel or recess 50 bounded by lips 51 preferably formed integrally with the remainder of reflector 11, as by extrusion. Each of end brackets 12, 13 has an end bracket flange 30 and an end plate 31 substantially perpendicular to end bracket flange 30. End bracket flange 30 is designed to fit, preferably relatively snugly, in wireway channel 50, secured by set screw 32, so that end plates 31 form the side walls of luminaire 10. Alternatively, if there is no wireway channel 50, individual recesses 40 could be provided at each end of reflector 11.

Lampholders 33, shown schematically, are preferably mounted on end plates 31. In the illustrated preferred embodiment, luminaire 10 is designed for use with standard fluorescent tubes, requiring one lampholder 33 at each end of reflector 11. However, other types of lamps, such as compact fluorescent lamps, may require a lampholder at only one end, in which case either only one lampholder 33 would be provided, or two lamps would be used, one at each end.

Luminaire 10, as part of its mount, also includes mounting brackets 14, 15. It should be understood that reflector 11 could be rotated about its longitudinal axis to any position within a large rotational range for, e.g., a ceiling mount, or even an upward-facing mount on a horizontal floor, ledge or shelf. However, as shown for purposes of illustration, mounting brackets 14, 15 are arranged so that luminaire 10 could be mounted on a wall (not shown) with reflector 11 aimed downward and outward. In practice, when mounted on a wall, luminaire 10 would more likely be rotated approximately 180° from the position shown, so that reflector 11 would be aimed upward and outward.

Each mounting bracket 14, 15 has a mounting flange 16 for attachment to the wall, ceiling or other mounting surface (not shown), and a mounting plate 17 substantially perpendicular to mounting flange 16. Where each mounting plate 17 of mounting bracket 14, 15 abuts an end plate 31 of end bracket 12, 13, one of the mounting plate and the end plate has a hole 70 therein, while the other has a stud 60 projecting therefrom for mating with hole 70. In the embodiment of FIGS. 1–8, mounting plate 17 of mounting bracket 14 bears stud 60, while end plate 31 of end bracket 12 has hole 70, and end plate 31 of end bracket 13 bears stud 60 while mounting plate 17 of mounting bracket 15 has hole 70.

To install luminaire 10, an installer would first install end flanges 30 of end brackets 12, 13 into wireway channel 50 using set screws 32. He or she would then attach mounting flange 16 of mounting bracket 14 to the mounting surface. Hole 70 in end plate 31 of end bracket 12 would then be positioned over stud 60 of mounting bracket 14 and reflector 11 would be moved laterally so that stud 60 passed through hole 70. Next, stud 60 of end bracket 13 would be inserted into hole 70 in mounting plate 17 of mounting bracket 15, and then mounting flange 16 of mounting bracket 15 would be attached to the mounting surface.

At that point, the attachment of mounting brackets 14, 15 to the mounting surface should be sufficient to prevent reflector 11 from coming loose. Nevertheless, in the preferred embodiment at least stud 60 of end bracket 13 is threaded, and threaded nut 20 is applied to it to make certain that reflector 11 is securely mounted. Preferably, for ease of manufacture, stud 60 of mounting bracket 14 is also threaded, so that only one type of stud need be provided. However, preferably no nut is applied to stud 60 of mounting bracket 14, even though it is possible to do so if desired. Similarly, non-threaded studs could be provided, if desired, for use where nuts will not be applied. In practice, where nut 20 is used, a washer (not shown) would likely also be used.

AS described thus far, luminaire 10 of FIGS. 1–8 is freely adjustable about the axis formed by studs 60. Preferably, however, luminaire 10 is provided with brake mechanism 80 which locks reflector 11 rotationally and also limits the range of available rotation. In the preferred embodiment, the brake mechanism includes a tab extending perpendicularly from end plate 31 having a threaded hole 81 therein for receiving a braking screw 82. Tip 61 of screw 82 cooperates with edge 71 of mounting plate 17 to frictionally brake reflector 11 against rotation when screw 82 is tightened, which would occur after reflector 11 has been adjusted to its desired rotational orientation. Tip 61 is necessarily out of the plane of end plate 31 by the distance along tab 21 between end plate 31 and hole 81. In order for tip 61 to engage edge 71, tip 61 must be in the plane of mounting plate 17. Therefore, end plate 31 is preferably provided with a boss 34 having a height substantially equal to the aforementioned distance, placing the tip 61 in the proper plane.

The shape of mounting plate 17 is important in assuring proper operation of brake mechanism 80. Portion 72 of mounting plate 17 is preferably rounded and centered on the rotational axis, to assure that tip 61 will reach edge 71 at any rotational position, although a shape other than round may be used provided screw 82 is long enough to compensate for any variations in distance between tab 21 and edge 71. In order to maximize the circumference of portion 72, and thus maximize the range of rotation, portion 72 is connected to a narrowed portion 73. Narrowed portion 73, together with the curvature of portion 72 and the contour of converging portion 74, also forms a "notch" to provide clearance for tab 21.

Brake mechanism 80 can be provided at one or both ends of luminaire 10. Preferably, brake mechanism 80 is provided at only one end of luminaire 10, but for purposes of illustration, it is shown at both ends in FIGS. 1, 2, 6 and 8 (brake mechanism 80 is not visible at the right end of FIG. 3 because it is in front of the plane of the drawing).

Figure 9:
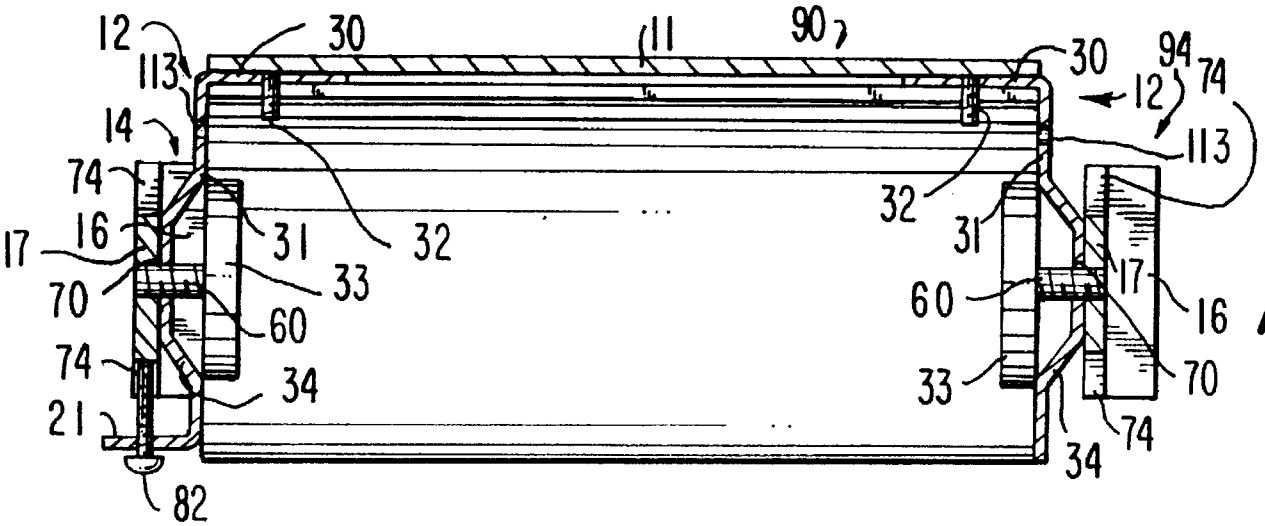
FIG. 9 is a longitudinal cross-sectional view, partly in elevation, similar to FIG. 3, of a second preferred embodiment of an adjustable luminaire according to the present invention.

A second preferred embodiment of a luminaire 90, and an adjustable mount therefor, according to the present invention, are shown in FIG. 9. Luminaire 90 and its adjustable mount are identical to those shown in FIGS. 1–8, except that in this embodiment, both studs 60 are provided on the two mounting brackets 14, 94 while both end brackets 12 have holes 70. Again, brake mechanism 80 could be provided at one or both ends.

Figure 10:
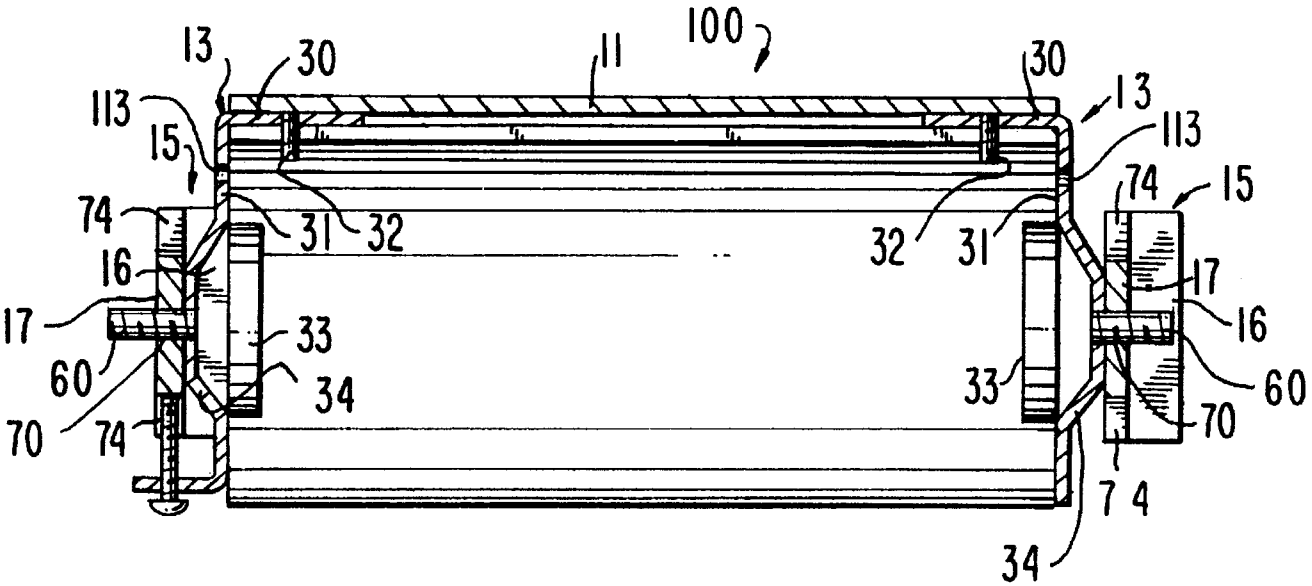
FIG. 10 is a longitudinal cross-sectional view, partly in elevation, similar to FIGS. 3 and 9, of a third preferred embodiment of an adjustable luminaire according to the present invention.

In a third embodiment, shown in FIG. 10, luminaire 100 is identical to luminaires 10, 90, except that here both studs 60 are provided on the two end brackets 13, while both mounting brackets 15 have holes 70. Here also, brake mechanism 80 could be provided at one or both ends. In addition, while no nut or other fastener is shown on either stud 60 in FIG. 10, nut 20 could be used on either or both studs 60 if desired.

Figure 11:
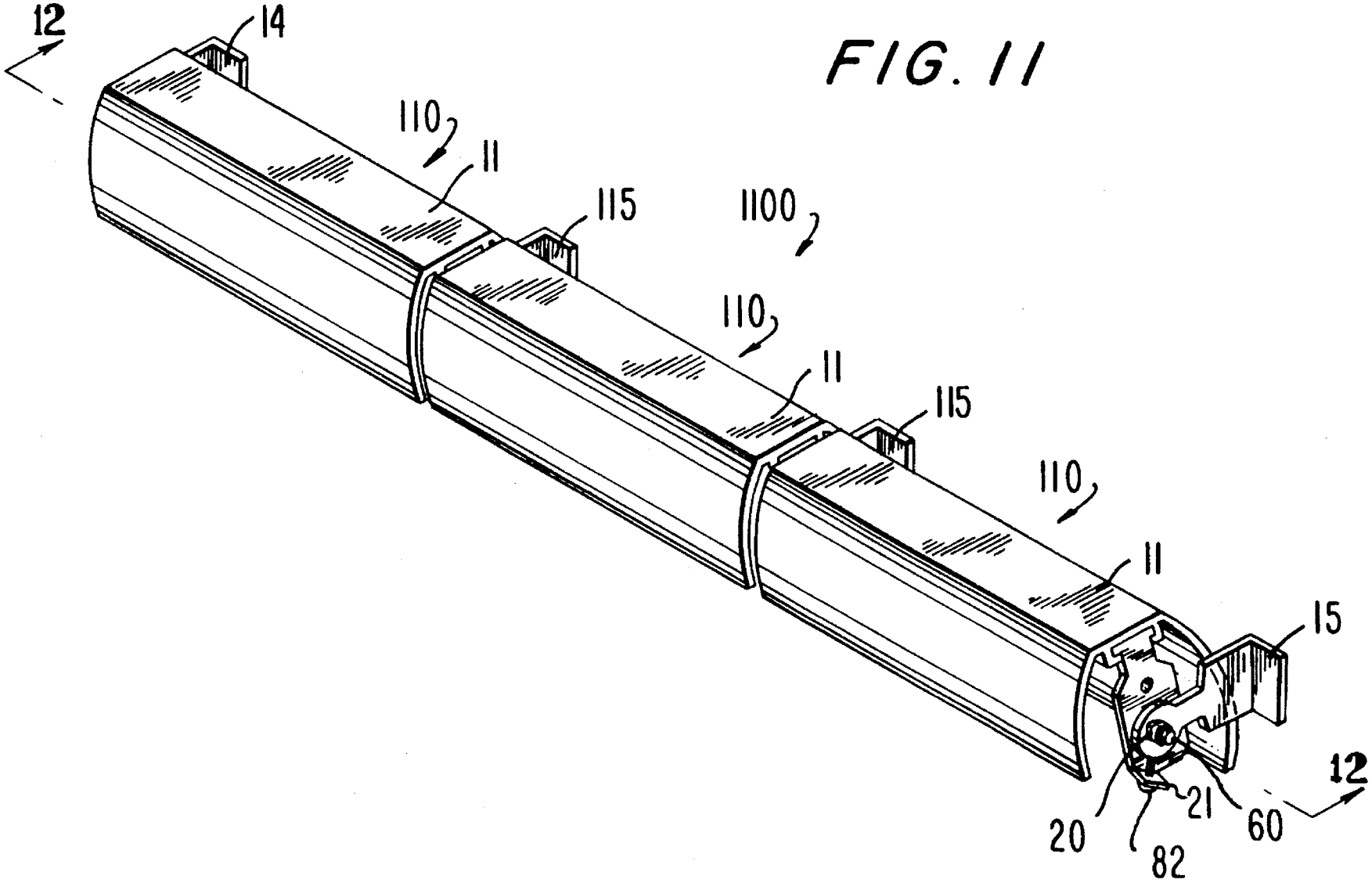
FIG. 11 is a longitudinal perspective view of a preferred embodiment of an adjustable luminaire system and an adjustable mounting system according to the present invention.
Figure 12:
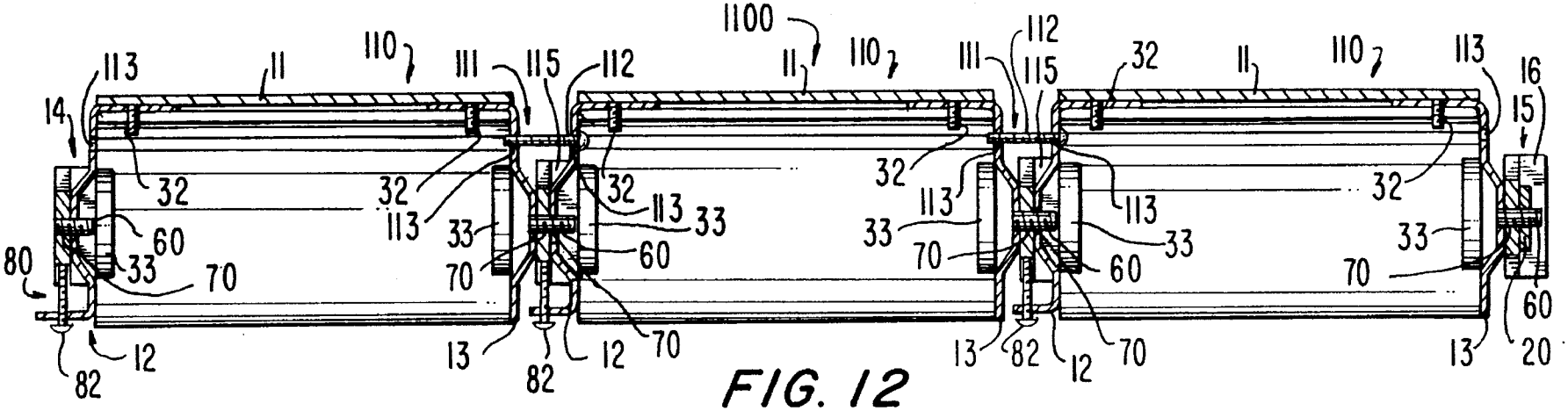
FIG. 12 is a longitudinal cross-sectional view, partly in elevation, of the embodiment of FIG. 11, taken from line 12—12 of FIG. 11.

A first preferred embodiment of an adjustable luminaire system, and an adjustable mounting system therefor, according to the invention, are shown in FIGS. 11 and 12. Luminaire system 1100 includes a plurality of luminaires 110 similar to luminaire 10. Each luminaire 110 has a reflector 11, a first end bracket 12 having a hole 70, and a second end bracket bearing a stud 60. At the first end of system 1100, a mounting bracket 14 bears stud 60 for insertion into hole 70 of first end bracket 12. At the second end of system 1100, a mounting bracket 15 has a hole 70 for insertion of a stud 60 borne by end bracket 13 of the last luminaire 110. Between each pair of adjacent luminaires is an intermediate mounting bracket 115, substantially identical to mounting bracket 15. In the system 1100 shown in FIGS. 11 and 12, there are three luminaires and thus two intermediate mounting brackets 115. At each intermediate mounting bracket 115, stud 60 from the adjacent end bracket 13 extends through hole 70 of mounting bracket 115 and then through hole 70 of adjacent end bracket 12.

If desired, a nut 20 can be used on any or all of studs 60 in system 1100. As shown, nut 20 is used only on the last stud 60, which protrudes at the end of system 1100 from mounting bracket 15.

Individual luminaires 110 of luminaire system 1100 can be aimed individually in different directions if desired. However, it is frequently desirable that all luminaires 110 be aimed in the same direction. To facilitate that common aiming, system 1100 is provided with alignment mechanisms 111 between adjacent luminaires. The preferred alignment mechanism 111 is an alignment screw 112 extending through alignment holes 113, which are provided in the same position on each end bracket 12, 13 (including those at the ends of system 1100 not adjacent other luminaires 110 in the system). Indeed, because single luminaires 10, 90 and 100 of FIGS. 1–10 would in practice be made from the same reflectors, end brackets and mounting brackets as luminaires 110 of system 1100, alignment holes 113 are visible in FIGS. 1–10, even though they are not used. Although shown on the inboard ends of endplates 31, alignment holes 113 could also be provided on the outboard ends of endplates 31— i.e., below boss 34 as viewed in FIG. 6, rather than above boss 34.

As shown in FIGS. 11 and 12, each of luminaires 110 is provided with brake mechanism 80 at at least one end thereof (the left end as seen in FIG. 12). The rightmost of luminaires 110 is shown with a brake mechanism 80 at both ends (see FIG. 11). For the other luminaires 110, the second brake mechanism, if present, would not be visible because they would be in front of the plane of FIG. 12.

If end brackets 12, 13 are identical as discussed above in connection with FIGS. 1–10, then relative rotation of adjacent ones of luminaires 110 would be limited because their respective tabs 21 would collide. Of course, if alignment screws 112 are used, relative rotation would not be a concern. However, if relative rotation is desired, and the limitation caused by the collision of tabs 21 is not acceptable, tab 21 could be omitted from one of end brackets 12, 13. This would require providing two different types of end brackets, unless tab 21 was provided with a break-away attachment, allowing differentiation of end brackets 12 and 13 in the field. Alternatively, end brackets 12 and 13 could be differentiated by providing tab 21 at a different radius from stud 60/hole 70 on the respective end brackets, so that tabs 21 of adjacent end brackets would not collide, at least when screws 82 are not inserted in holes 81.

As in the case of the luminaires of FIGS. 1–10, it is not necessary to use brake mechanisms 80 at each end of an individual luminaire 110 even when alignment screws 112 are not used. When alignment screws 112 are used, it is even less necessary to use brake mechanism 80 at each end because two brake mechanisms would be immediately adjacent one another and the respective end brackets being braked are linked together. In fact, it may not even be necessary to use a brake mechanism 80 on every luminaire 110 in system 1100 if alignment screws 112 are used.

Figure 13:
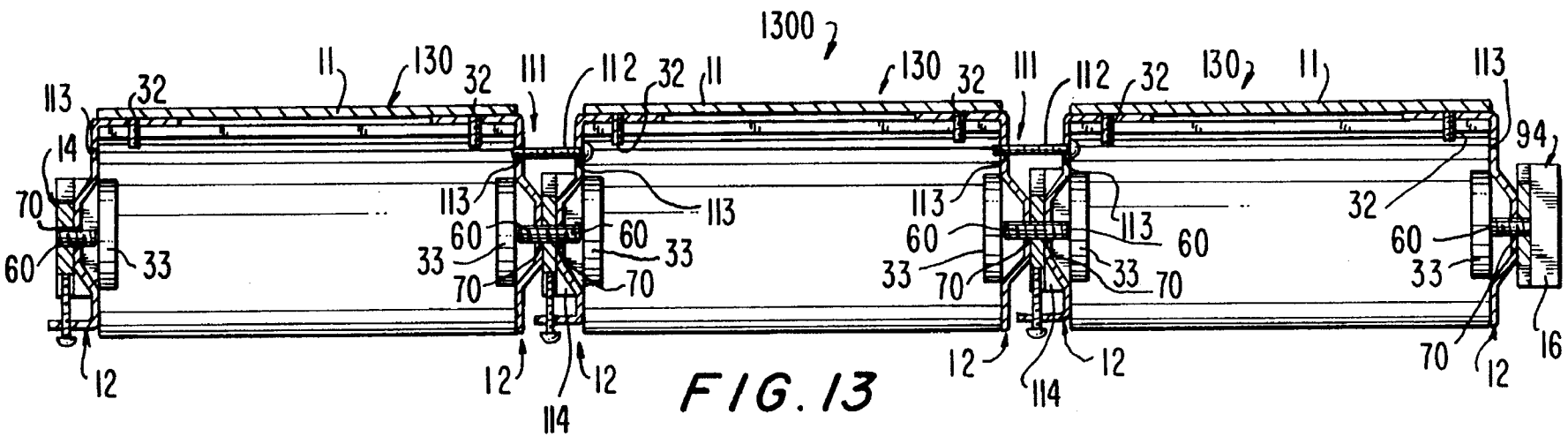
FIG. 13 is a longitudinal cross-sectional view, partly in elevation, similar to FIG. 12, of a second preferred embodiment of an adjustable luminaire system and an adjustable mounting system according to the present invention.

An second preferred embodiment of a luminaire system 1300, and an adjustable mounting system therefor, according to the invention, is shown in FIG. 13. System 1300 is similar to system 1100, except that each luminaire 130 has two end brackets 12 having holes 70, instead of one end bracket 12 with hole 70 and one end bracket 13 with stud 60. A mounting bracket 14, 94 with stud 60 is used at each end of system 1300, while intermediate mounting brackets 114 are used between adjacent luminaires 130. Each intermediate mounting bracket 114 has two studs 60 extending in opposite directions from one another, each engaging hole 70 in one of the two adjacent end brackets 12. System 1300 is otherwise identical to system 1100, particularly with respect to brake mechanisms 80 and alignment mechanisms 111.

Installation of either preferred system 1100 or 1300 is similar to the installation of a single luminaire as discussed above. For either preferred system 1100, 1300 as described , it would be necessary to complete installation of each individual luminaire, including installing the reflector and then installing the intermediate mounting bracket between it and the next luminaire, before installing any other part of further luminaires. For example, in these preferred embodiments it would not be possible to install all mounting brackets in advance of any reflectors.

Installation of luminaires and luminaire systems according to the present invention is simplified by the elimination of parts such as, for example, the separate locking clamps described above. In addition, the elimination of separate mounting arms on the intermediate mounting brackets further reduces the spacing between individual lamps, subject only to the heights of two bosses 34, thus reducing dark spots in the output lighting pattern.

Thus it is seen that an adjustable luminaire or luminaire system, and a respective adjustable mount or mounting system therefor, that further minimizes dark spots in the lighting pattern, while allowing easy installation and adjustment, and providing a more effective braking mechanism, as compared to previously known systems, are provided. One skilled in the art will appreciate that the present invention can be practiced by other than the described embodiments, which are presented for purposes of illustration and not of limitation, and the present invention is limited only by the claims which follow.

What is claimed is:

1. An adjustable luminaire for attachment to a mounting surface, said adjustable luminaire comprising:

an elongated reflector having first and second ends, said reflector extending lengthwise in a first direction between said first and second ends;

two end brackets, each of said end brackets having:

an end bracket flange for mating with said reflector, and an end plate substantially perpendicular to said flange; and two mounting brackets for attaching said adjustable luminaire to said mounting surface, each of said mounting brackets having:

a mounting flange for attaching to said mounting surface, and a mounting plate substantially perpendicular to said mounting flange for attaching to said end plate; wherein:

at each said end, one of said end plate and said mounting plate bears a mounting stud and the other of said end plate and said mounting plate has a hole therein for rotatably receiving said mounting stud, whereby said reflector is rotatably adjustable within a range of adjustment about an axis extending from said first end to said second end along said first direction;

each said mounting plate has a mounting plate edge; and at least one of said end plates has a brake for cooperating with the mounting plate edge of a respective one of said mounting plates to lock said reflector against rotation about said axis.

2. The adjustable luminaire of claim 1 further comprising at least one lampholder mounted on one of said end plates.

3. The adjustable luminaire of claim 2 comprising two lampholders, one of said lampholders being mounted on each of said end plates.

4. The adjustable luminaire of claim 1 wherein:

said reflector has a substantially flat recess extending along said first direction from each of said first and second ends toward the other of said first and second ends; and said end bracket flange mates with said recess.

5. The adjustable luminaire of claim 4 wherein said recess is a single recess extending from said first end to said second end.

6. The adjustable luminaire of claim 4 wherein said recess comprises a first partial recess extending from said first end toward said second end and a second partial recess extending from said second end toward said first end.

7. The adjustable luminaire of claim 1 wherein each of said mounting plates bears one said mounting stud and each of said end plates has one of said holes therein.

8. The adjustable luminaire of claim 1 wherein each of said end plates bears one said mounting stud and each of said mounting plates has one of said holes therein.

9. The adjustable luminaire of claim 1 wherein:

at said first end, said mounting plate bears said mounting stud and said end plate has said hole therein; and at said second end, said end plate bears said mounting stud and said mounting plate has said hole therein; said adjustable luminaire further comprising:

a fastener fixed to said mounting stud at said second end for preventing removal of said mounting stud from said hole in said mounting plate.

10. The adjustable luminaire of claim 9 wherein:

said mounting stud at said second end is threaded; and said fastener is a threaded nut.

11. The adjustable luminaire of claim 1 wherein said mounting plate edge defines a contour for cooperating with said brake to limit said range of adjustment.

12. The adjustable luminaire of claim 1 comprising one said brake at each of said first and second ends.

13. The adjustable luminaire of claim 1 wherein said brake comprises:

a tab extending substantially perpendicularly from said end plate and having a threaded opening therein; and a screw extending through said threaded opening and having a tip that bears against said mounting plate edge when tightened to frictionally prevent rotation of said reflector about said axis.

14. The adjustable luminaire of claim 13 wherein:

said threaded opening is positioned in said tab a given distance from said end plate; and said end plate comprises a boss where said one of said hole and said mounting stud is located on said end plate, said boss bearing against said respective one of said mounting plates and having a boss height substantially equal to said given distance; whereby:

said tip of said screw is substantially aligned with said mounting plate edge.

15. The adjustable luminaire of claim 1 wherein the end plates of said two end brackets are substantially identical to one another.

16. An adjustable mount for attachment of a luminaire to a mounting surface, said luminaire including an elongated reflector having first and second ends, said reflector extending lengthwise in a first direction between said first and second ends, said adjustable mounting comprising:

two end brackets, each of said end brackets having:

an end bracket flange for mating with said reflector, and an end plate substantially perpendicular to said flange; and two mounting brackets for attaching said adjustable mounting to said mounting surface, each of said mounting brackets having:

a mounting flange for attaching to said mounting surface, and a mounting plate substantially perpendicular to said mounting flange for attaching to said end plate; wherein:

at each said end, one of said end plate and said mounting plate bears a mounting stud and the other of said end plate and said mounting plate has a hole therein for rotatably receiving said mounting stud, whereby said reflector, when attached to said mount, is rotatably adjustable within a range of adjustment about an axis extending from said first end to said second end along said first direction;

each said mounting plate has a mounting plate edge; and at least one of said end plates has a brake for cooperating with the mounting plate edge of a respective one of said mounting plates to lock said reflector against rotation about said axis.

17. The adjustable mount of claim 16 wherein each of said mounting plates bears one said mounting stud and each of said end plates has one of said holes therein.

18. The adjustable mount of claim 16 wherein each of said end plates bears one said mounting stud and each of said mounting plates has one of said holes therein.

19. The adjustable mount of claim 16 wherein:

at said first end, said mounting plate bears said mounting stud and said end plate has said hole therein; and at said second end, said end plate bears said mounting stud and said mounting plate has said hole therein; said adjustable mounting further comprising:

a fastener fixed to said mounting stud at said second end for preventing removal of said mounting stud from said hole in said mounting plate.

20. The adjustable mount of claim 19 wherein:

said mounting stud at said second end is threaded; and said fastener is a threaded nut.

21. The adjustable mount of claim 16 wherein said mounting plate edge defines a contour for cooperating with said brake to limit said range of adjustment.

22. The adjustable mount of claim 16 comprising one said brake at each of said first and second ends.

23. The adjustable mount of claim 16 wherein said brake comprises:

a tab extending substantially perpendicularly from said end plate and having a threaded opening therein; and a screw extending through said threaded opening and having a tip that bears against said mounting plate edge when tightened to frictionally prevent rotation of said reflector about said axis.

24. The adjustable mount of claim 23 wherein:

said threaded opening is positioned in said tab a given distance from said end plate; and said end plate comprises a boss where said one of said hole and said mounting stud is located on said end plate, said boss bearing against said respective one of said mounting plates and having a boss height substantially equal to said given distance; whereby:

said tip of said screw is substantially aligned with said mounting plate edge.

25. The adjustable mount of claim 16 wherein the end plates of said two end brackets are substantially identical to one another.

26. An adjustable luminaire system for attachment to a mounting surface, said adjustable luminaire system having first and second system ends and comprising:

a first number of elongated reflectors each having first and second reflector ends, each said reflector extending lengthwise in a first direction between said first and second reflector ends, wherein:

said first reflector end of one of said reflectors is located at said first system end and a second reflector end of another of said reflectors is located at said second system end;

two end brackets associated with each said reflector, each of said end brackets having:

an end bracket flange for mating with said reflector, and an end plate substantially perpendicular to said flange; and a second number of mounting brackets for attaching said adjustable luminaire system to said mounting surface, said second number exceeding said first number by one, each of said mounting brackets having:

a mounting flange for attaching to said mounting surface, and a mounting plate substantially perpendicular to said mounting flange for attaching to at least one of said end plates; wherein:

at each said reflector end, one of said end plate and said mounting plate bears a mounting stud and the other of said end plate and said mounting plate has a hole therein for rotatably receiving said mounting stud, whereby said reflector is rotatably adjustable within a range of adjustment about an axis extending from said first reflector end to said second reflector end along said first direction;

each said mounting plate has a mounting plate edge; and for each of said reflectors, at least one of said end plates has a brake for cooperating with the mounting plate edge of a respective one of said mounting plates to lock said one of said reflectors against rotation about said axis.

27. The adjustable luminaire system of claim 26 further comprising, for each said reflector, at least one lampholder mounted on one of said end plates.

28. The adjustable luminaire system of claim 27 comprising, for each said reflector, two lampholders, one of said lampholders being mounted on each of said end plates.

29. The adjustable luminaire system of claim 26 wherein:

at least one of said reflectors comprises a substantially flat recess extending along said first direction from each of said first and second reflector ends toward the other of said first and second reflector ends; and said end bracket flange of each said end bracket associated with said at least one reflector mates with said recess.

30. The adjustable luminaire system of claim 29 wherein, for said at least one of said reflectors, said recess is a single recess extending from said first reflector end to said second reflector end.

31. The adjustable luminaire system of claim 29 wherein, for said at least one of said reflectors, said recess comprises a first partial recess extending from said first reflector end toward said second reflector end and a second partial recess extending from said second reflector end toward said first reflector end.

32. The adjustable luminaire system of claim 26 wherein:

for all but said mounting brackets at said system ends, each of said mounting plates bears two said mounting studs extending away from each other parallel to said first direction;

each said mounting bracket at one of said system ends bears one said mounting stud extending toward the other of said system ends; and each of said end plates has one of said holes therein.

33. The adjustable luminaire system of claim 26 wherein:

for each of said reflectors, said end plate at said first reflector end has said hole therein, and said end plate at said second reflector end bears one said mounting stud extending away from said first reflector end parallel to said first direction;

said mounting plate at said first system end bears one said mounting stud extending through said hole in said end plate at said first reflector end of said one of said reflectors adjacent said first system end; and each said mounting plate other than said mounting plate at said first system end has said hole therein.

34. The adjustable luminaire system of claim 33 further comprising at least one fastener fixed to at least one of said mounting studs for preventing removal of said mounting stud from said hole.

35. The adjustable luminaire system of claim 34 wherein:

at least one of said mounting studs is threaded; and said at least one fastener is a threaded nut.

36. The adjustable luminaire system of claim 26 wherein said mounting plate edge defines a contour for cooperating with said brake to limit said range of adjustment.

37. The adjustable luminaire system of claim 26 comprising one said brake at each of said first and second ends of each of said reflectors.

38. The adjustable luminaire system of claim 26 wherein said brake comprises:

a tab extending substantially perpendicularly from said end plate and having a threaded opening therein; and a screw extending through said threaded opening and having a tip that bears against said mounting plate edge when tightened to frictionally prevent rotation of said reflector about said axis.

39. The adjustable luminaire system of claim 38 wherein:

said threaded opening is positioned in said tab a given distance from said end plate; and said end plate comprises a boss where said one of said hole and said mounting stud is located on said end plate, said boss bearing against said respective one of said mounting plates and having a boss height substantially equal to said given distance; whereby:

said tip of said screw is substantially aligned with said mounting plate edge.

40. The adjustable luminaire system of claim 26 wherein, for each said reflector, the end plates of said two end brackets are substantially identical to one another.

41. The adjustable luminaire system of claim 40 wherein, where the end plate at the first end of one of said reflectors is adjacent the end plate at the second end of another of said reflectors, the tabs of the respective end plates interfere with one another, such that the range of adjustment of each said reflector is limited by adjustment of adjacent reflectors.

42. The adjustable luminaire system of claim 26 further comprising at least one aligner for maintaining common angular adjustment of at least two adjacent ones of said reflectors.

43. The adjustable luminaire system of claim 42 comprising one of said aligners between each pair of adjacent end plates.

44. The adjustable luminaire system of claim 42 wherein:

each said end plate has an alignment hole therein; and said aligner comprises a screw extending through alignment holes of adjacent end plates.

45. The adjustable luminaire system of claim 26 wherein, for each said reflector, the end plates of said two end brackets are substantially identical to one another.

46. The adjustable luminaire system of claim 45 wherein all of said end plates are substantially identical to one another.

47. An adjustable mounting system for attachment of a luminaire system to a mounting surface, said luminaire system having first and second system ends and including a first number of elongated reflectors each having first and second reflector ends, each said reflector extending lengthwise in a first direction between said first and second reflector ends, wherein said first reflector end of one of said reflectors is located at said first system end and a second reflector end of another of said reflectors is located at said second system end, said adjustable mounting system comprising:

two end brackets for association with each said reflector, each of said end brackets having:

an end bracket flange for mating with said reflector, and an end plate substantially perpendicular to said flange; and a second number of mounting brackets for attaching said adjustable luminaire system to said mounting surface, said second number exceeding said first number by one, each of said mounting brackets having:

a mounting flange for attaching to said mounting surface, and a mounting plate substantially perpendicular to said mounting flange for attaching to at least one of said end plates; wherein:

at each said reflector end, one of said end plate and said mounting plate bears a mounting stud and the other of said end plate and said mounting plate has a hole therein for rotatably receiving said mounting stud, whereby each said reflector, when attached to said mounting system, is rotatably adjustable within a range of adjustment about an axis extending from said first reflector end to said second reflector end along said first direction;

each said mounting plate has a mounting plate edge; and for each of said reflectors, at least one of said end plates has a brake for cooperating with the mounting plate edge of a respective one of said mounting plates to lock said one of said reflectors against rotation about said axis.

48. The adjustable mounting system of claim 47 wherein:

for all but said mounting brackets at said system ends, each of said mounting plates bears two said mounting studs extending away from each other parallel to said first direction;

each said mounting bracket at one of said system ends bears one said mounting stud extending toward the other of said system ends; and each of said end plates has one of said holes therein.

49. The adjustable mounting system of claim 47 wherein:

for each of said reflectors, said end plate at said first reflector end has said hole therein, and said end plate at said second reflector end bears one said mounting stud extending away from said first reflector end parallel to said first direction;

said mounting plate at said first system end bears one said mounting stud extending through said hole in said end plate at said first reflector end of said one of said reflectors adjacent said first system end; and each said mounting plate other than said mounting plate at said first system end has said hole therein.

50. The adjustable mounting system of claim 49 further comprising at least one fastener fixed to at least one of said mounting studs for preventing removal of said mounting stud from said hole.

51. The adjustable mounting system of claim 50 wherein:

at least one of said mounting studs is threaded; and said at least one fastener is a threaded nut.

52. The adjustable mounting system of claim 47 wherein said mounting plate edge defines a contour for cooperating with said brake to limit said range of adjustment.

53. The adjustable mounting system of claim 47 comprising one said brake at each of said first and second ends of each of said reflectors.

54. The adjustable mounting system of claim 47 wherein said brake comprises:

a tab extending substantially perpendicularly from said end plate and having a threaded opening therein; and a screw extending through said threaded opening and having a tip that bears against said mounting plate edge when tightened to frictionally prevent rotation of said reflector about said axis.

55. The adjustable mounting system of claim 54 wherein:

said threaded opening is positioned in said tab a given distance from said end plate; and said end plate comprises a boss where said one of said hole and said mounting stud is located on said end plate, said boss bearing against said respective one of said mounting plates and having a boss height substantially equal to said given distance; whereby:

said tip of said screw is substantially aligned with said mounting plate edge.

56. The adjustable mounting system of claim 47 wherein, for each said reflector, the end plates of said two end brackets are substantially identical to one another.

57. The adjustable mounting system of claim 56 wherein, where the end plate at the first end of one of said reflectors is adjacent the end plate at the second end of another of said reflectors, the tabs of the respective end plates interfere with one another, such that the range of adjustment of each said reflector is limited by adjustment of adjacent reflectors.

58. The adjustable mounting system of claim 47 further comprising at least one aligner for maintaining common angular adjustment of at least two adjacent ones of said reflectors.

59. The adjustable mounting system of claim 58 comprising one of said aligners between each pair of adjacent end plates.

60. The adjustable mounting system of claim 58 wherein:

each said end plate has an alignment hole therein; and said aligner comprises a screw extending through alignment holes of adjacent end plates.

61. The adjustable mounting system of claim 47 wherein, for each said reflector, the end plates of said two end brackets are substantially identical to one another.

62. The adjustable luminaire system of claim 61 wherein all of said end plates are substantially identical to one another.

* * * * *

UNITED STATES PATENT AND TRADEMARK OFFICE

CERTIFICATE OF CORRECTION

PATENT NO. : 5,550,725
DATED : August 27, 1996
INVENTOR(S) : Sylvan R. Shemitz et al.

It is certified that error appears in the above-indentified patent and that said Letters Patent is hereby corrected as shown below:

Column 1, line 49, "is" should be -- its --.

Column 2, line 56, "cross sectional" should be -- cross-sectional --.

Column 6, line 11, "AS" should be -- As --.

Column 7, line 36, "endplates" should be -- end plates --;
line 37, "endplates" should be -- end plates --.

Column 8, line 7, "An" should be -- A --;
line 23, "described" should be -- described, --;
line 24, ", it" should be -- it --.

Claim 62, column 16, line 4, "luminaire" should be -- mounting --.

Signed and Sealed this

Fourteenth Day of December, 1999

*Attest:*

Q. TODD DICKINSON

*Attesting Officer*

*Acting Commissioner of Patents and Trademarks*